219-121 SR
3/18/86 XR 4,576,828

United States Patent [19]
Walker, Jr.

[11] Patent Number: 4,576,828
[45] Date of Patent: Mar. 18, 1986

[54] METHOD AND APPARATUS FOR PLASMA SPRAY COATING

[75] Inventor: Frank A. Walker, Jr., Huntington Beach, Calif.

[73] Assignee: Geotel, Inc., Amityville, N.Y.

[21] Appl. No.: 611,474

[22] Filed: May 17, 1984

[51] Int. Cl.[4] ..... B05D 1/08
[52] U.S. Cl. ..... 427/34; 118/668; 198/619; 219/121 PX; 427/423
[58] Field of Search ..... 427/34, 423; 219/121 P; 198/619; 118/668

[56] References Cited

U.S. PATENT DOCUMENTS

| | | | |
|---|---|---|---|
| 3,086,882 | 4/1963 | Smith, Jr. et al. | 117/54 |
| 3,426,887 | 2/1969 | Ward et al. | 198/619 |
| 3,473,954 | 10/1969 | Mattson | 117/107.1 |
| 3,568,632 | 3/1971 | Cawthon | 118/49 |
| 3,656,454 | 4/1972 | Schrader | 118/49 |
| 3,814,447 | 6/1974 | Prasse et al. | 277/224 |
| 3,839,618 | 10/1974 | Muehlberger | 219/121 |
| 3,914,573 | 10/1975 | Muehlberger | 219/76 |
| 4,004,042 | 1/1977 | Fairbairn | 427/34 |
| 4,015,558 | 4/1977 | Small et al. | 118/6 |
| 4,037,074 | 7/1977 | Montbrun et al. | 219/121 P X |
| 4,166,563 | 9/1979 | Peyraud et al. | 198/619 |
| 4,184,448 | 1/1980 | Airchert et al. | 118/729 |
| 4,313,783 | 2/1982 | Davies et al. | 156/643 |

FOREIGN PATENT DOCUMENTS

| | | | |
|---|---|---|---|
| 892847 | 1/1944 | France | 198/619 |
| 55-89131 | 5/1980 | Japan | 198/619 |

OTHER PUBLICATIONS

IBM Technical Disclosure Bulletin, vol. 11, No. 7, two pages.
IBM Technical Disclosure Bulletin, vol. 17, No. 8, two pages.
Machine Design, Mar. 19, 1970, pp. 2–6.

*Primary Examiner*—John H. Newsome
*Attorney, Agent, or Firm*—Gausewitz, Carr and Rothenberg

[57] ABSTRACT

Plasma spray coating of parts in a low-pressure chamber utilizes a linear induction motor drive system having gapped tracks for supporting and driving part carriers to flow in a continuous series of discrete steps through the low-pressure chamber where the parts are momentarily stopped for preheating and spray coating. Input and output air locks are sealed and unsealed by valve gates that move through the track gaps to optimize the sealing of the locks.

18 Claims, 8 Drawing Figures

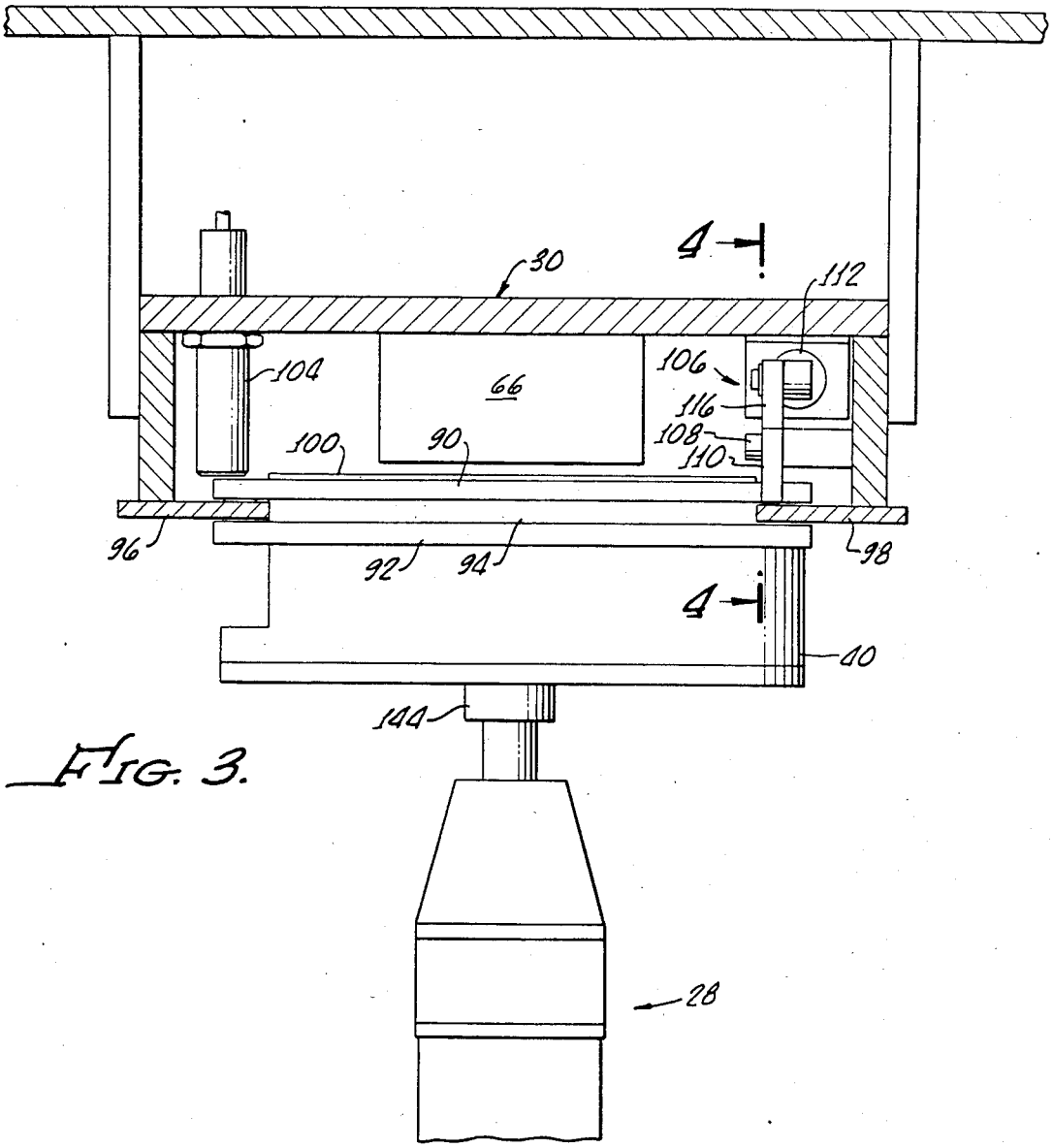
FIG. 3.
FIG. 4.
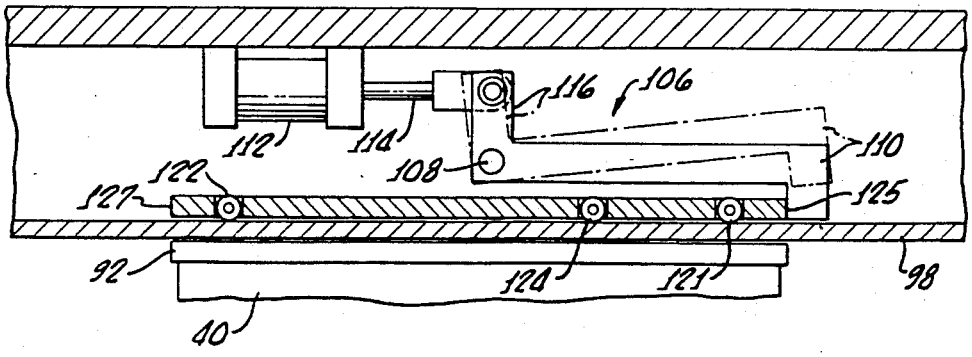

| PROCESS STEPS | 1 | 2 | 3 | 4 | 5 | 6 | 7 |
|---|---|---|---|---|---|---|---|
| ENTRANCE STATION 32 | $P_5$ | $P_5$ | $P_6$ | $P_6$ | $P_7$ | $P_7$ | $P_8$ |
| OUTER LOAD VALVE 46 | C | C | O | C | O | C | O |
| LOAD LOCK 16 | $P_4$ | | $P_5$ | | $P_6$ | | $P_7$ |
| INNER LOAD VALVE 44 | C | O | C | O | C | O | C |
| PREHEAT 1 | $P_3$ | $P_4$ | $P_4$ | $P_5$ | $P_5$ | $P_6$ | $P_6$ |
| PREHEAT 2 | $P_2$ | $P_3$ | $P_3$ | $P_4$ | $P_4$ | $P_5$ | $P_5$ |
| SPRAY | $P_1$ | $P_2$ | $P_2$ | $P_3$ | $P_3$ | $P_4$ | $P_4$ |
| INNER UNLOAD VALVE 48 | C | O | C | O | C | O | C |
| UNLOAD LOCK 18 | | $P_1$ | | $P_2$ | | $P_3$ | |
| OUTER UNLOAD VALVE 50 | C | C | O | C | O | C | O |
| EXIT STATION 34 | | | $P_1$ | | $P_2$ | | $P_3$ |

METHOD AND APPARATUS FOR PLASMA SPRAY COATING

BACKGROUND OF THE INVENTION

The present invention relates to plasma spray coating of parts, and more particularly concerns continuous process spray coating in a controlled environment.

Plasma spray coating of parts is often performed by an electric torch that generates a plasma stream of very high velocity and temperature. Materials, in the form of fine powder, that are to be spray coated upon a part are injected into a high velocity plasma stream and caused to impinge upon the part to provide the desired coating. An example of an electric arc plasma spray gun for use in such a process is shown in U.S. Pat. No. 3,914,573. It is often desired to carry out such plasma spray coating in a reduced oxygen or other controlled environment, so as to minimize oxidation or other chemical changes of the powder and part in the spraying process, or to confine toxic vapors. U.S. Pat. No. 3,839,618 illustrates such a reduced pressure or controlled environment plasma spraying operation.

Vacuum chamber plasma spray coating, for production of large quantities of sprayed parts, is presently performed by batch-type processing. For example, in spray coating turbine blades, a number (such as one hundred) of blades are mounted on a carrier which is placed in the chamber. The chamber is then sealed and evacuated, and the parts are preheated and sprayed, generally one at a time. In the process, the parts are heated to several thousand degrees Fahrenheit, but after a part is coated, it must remain on the carrier within the chamber until all other blades in the batch have been coated. The heated and coated parts, and their supports, act as massive heat sinks within the chamber, retaining a substantial amount of the heat of the plasma spray, and tending to cause an undesired buildup of heat within the chamber. Complex and expensive cooling systems are required to remove such heat from the chamber.

Not only does the batch spray coating process present serious heat control problems in a low pressure chamber, but the batch processing itself is inherently slow. Time is required in such batch processing to load and unload the parts and to repeatedly evacuate the relatively large volume of the processing chamber. During such loading, unloading, and chamber evacuation, no spraying or preheating can occur. According to presently known batch processing systems for electric arc plasma spray coating, a total of ten hours may be required to spray coat one hundred turbine blades, providing the slow production rate of approximately ten blades per hour.

Accordingly, it is an object of the present invention to provide for plasma spray coating of parts with a process and apparatus that substantially minimizes above-mentioned problems.

SUMMARY OF THE INVENTION

In carrying out principles of the present invention in accordance with a preferred embodiment thereof, plasma spray coating is carried out in a continuous flow-through process by moving parts in discrete short steps through a low pressure chamber having input and output air locks that are sealed by gate valves. The valve gates are movable into gaps of a track that extends through the chamber and through the air locks. A plurality of induction motor stators are fixedly mounted to the track within the processing chamber and at opposite sides of the track gaps. Part carriers, each longer than the track gaps, are provided with armatures to enable the carriers to be continuously driven along the length of the track and across the gaps. The chamber is substantially T-shaped, with the electric arc spray gun in the central leg of the T and the track extending across the central leg so that the carriers will move the parts to cross the T. Although the parts move and the various operations are carried out in discrete steps, the various steps may be sequenced so that several may occur at the same time, thereby minimizing the total time required for processing. Because of the substantially continuous type flow-through operation, and because each part may be removed from the low pressure spray chamber directly after it has been sprayed, heat buildup problems are greatly alleviated.

BRIEF DESCRIPTION OF THE DRAWINGS

FIG. 3 is a sectional view showing the track supported carrier and carrier sensing and stop mechanisms;

FIG. 4 shows further detail of a carrier stop mechanism;

DETAILED DESCRIPTION OF THE INVENTION

Figure 1:
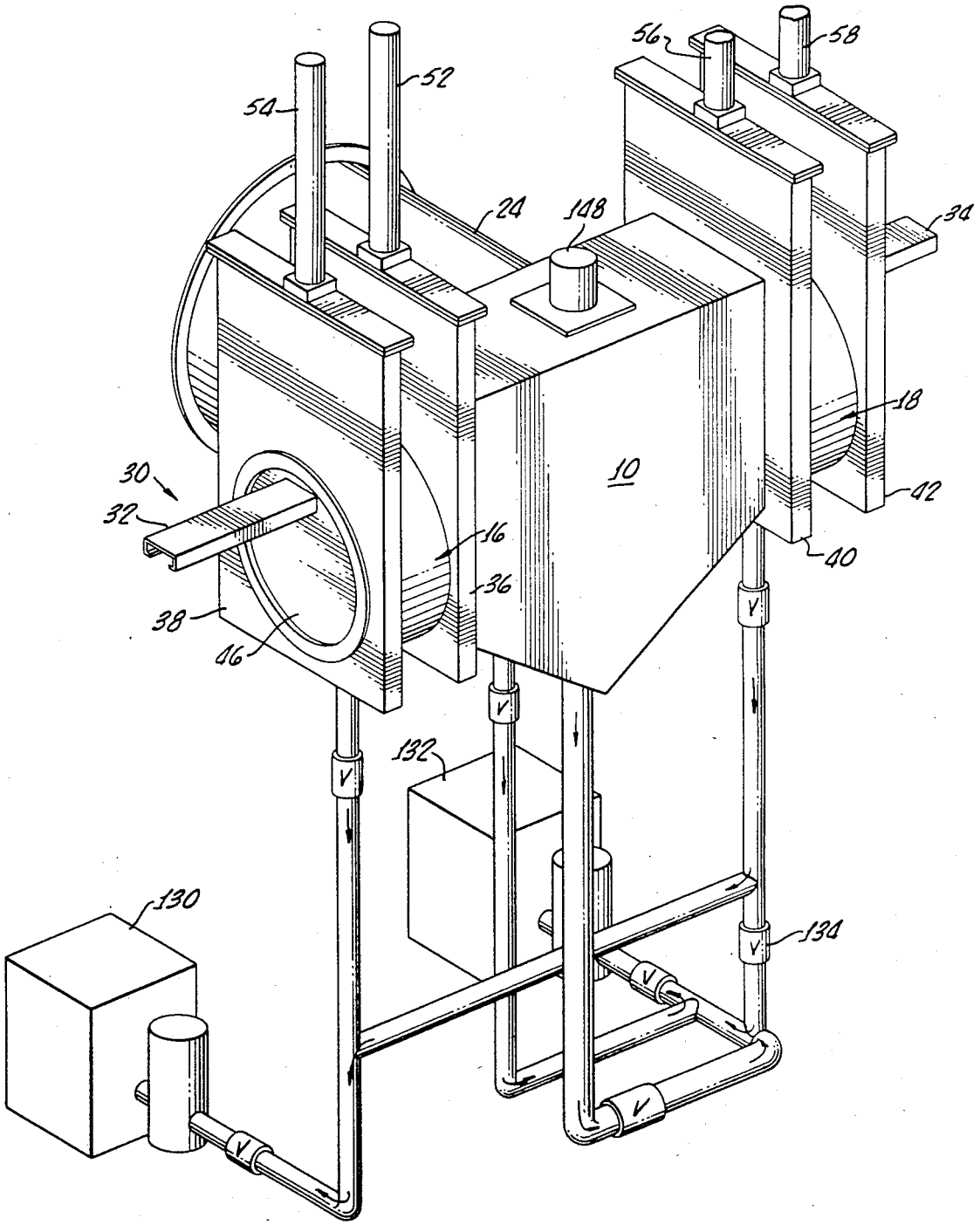
FIG. 1 is a perspective view of an electric arc plasma spray coating apparatus embodying principles of the present invention.
Figure 2:
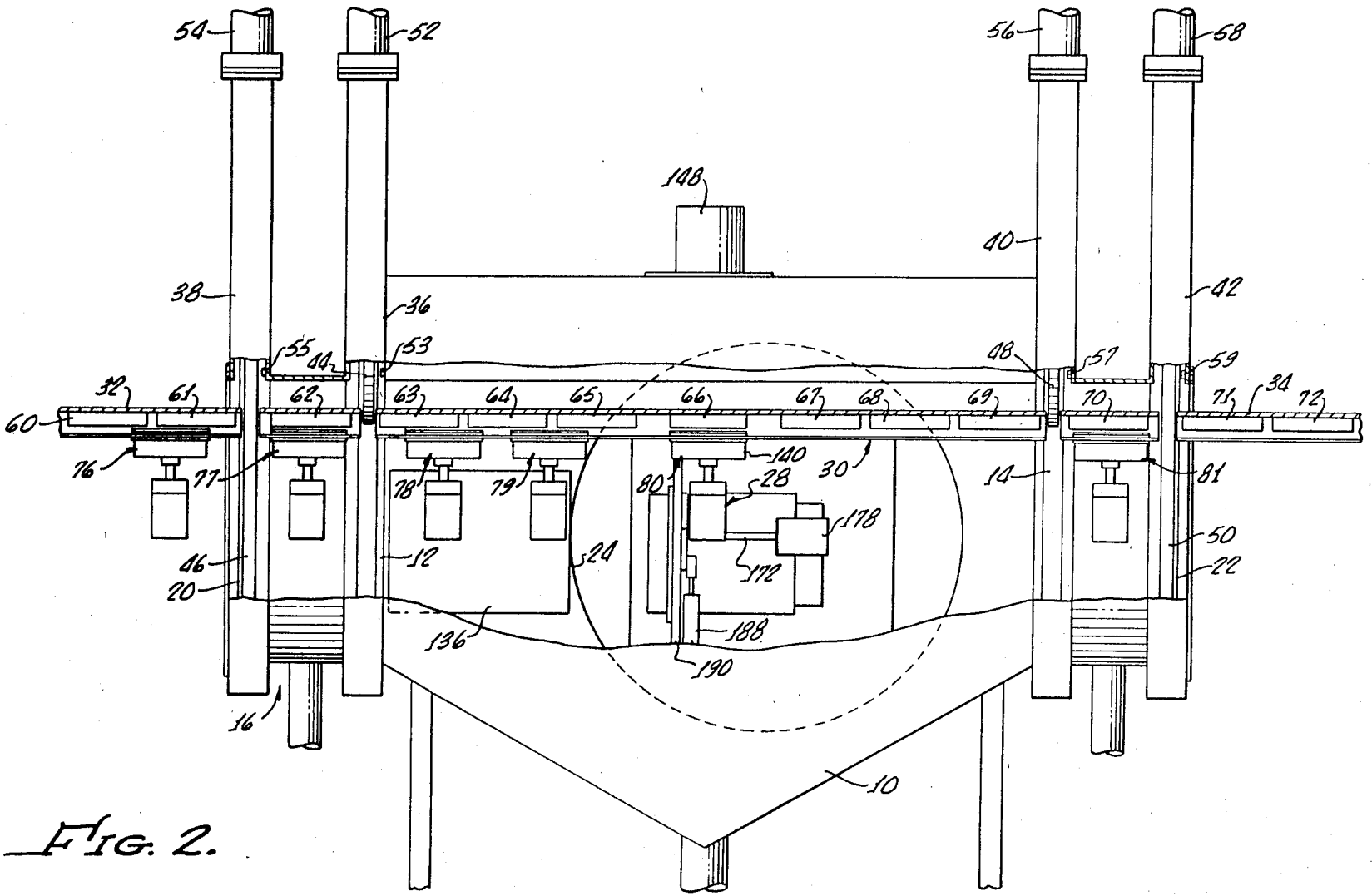
FIG. 2 is a front view, with parts broken away, of the apparatus of FIG. 1.
Figure 6:
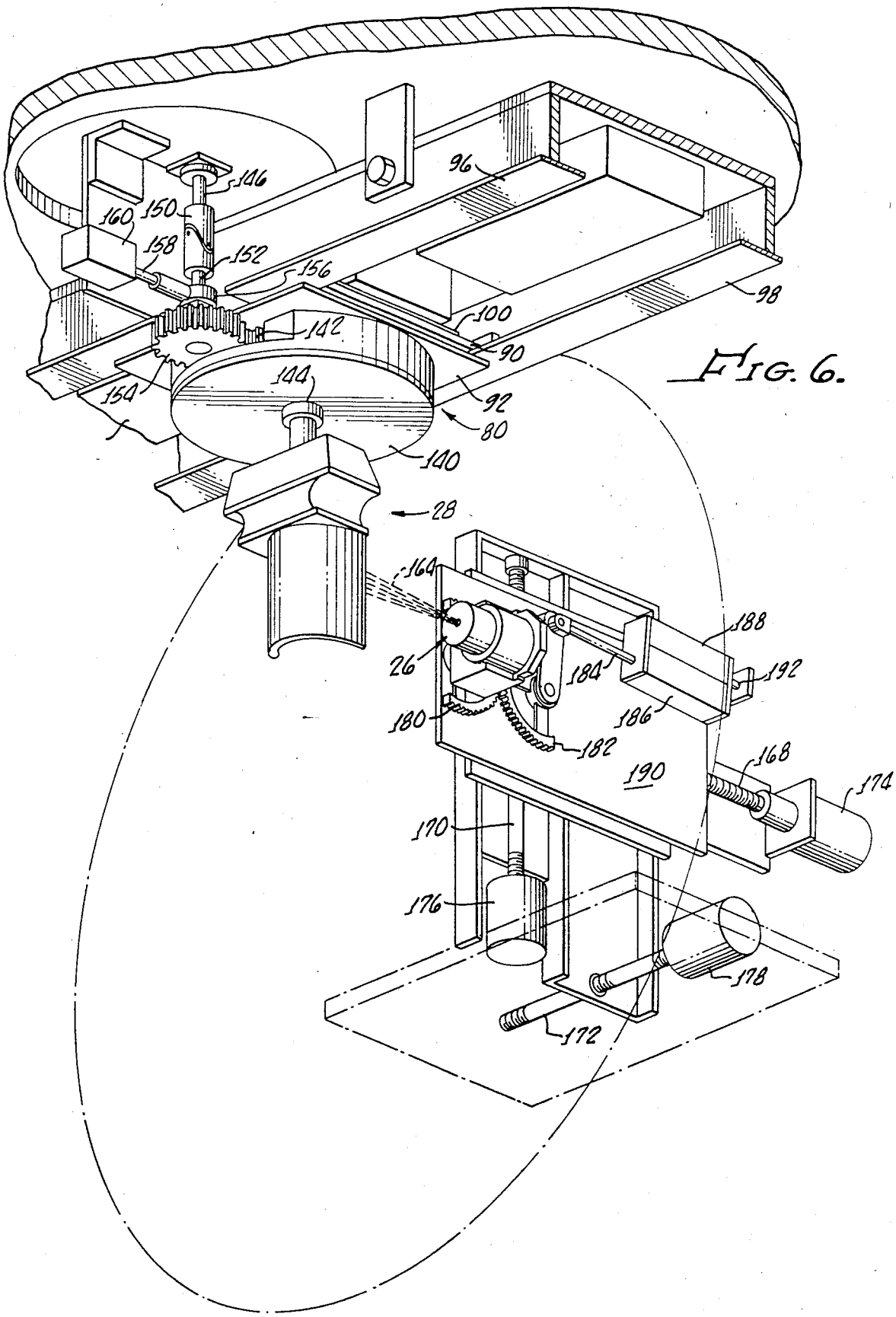
FIG. 6 is a pictorial view showing the spray gun and a part at the spray station.

As illustrated in FIGS. 1 and 2, a system embodying principles of the present invention comprises a vacuum chamber 10 having input and output ports 12 and 14, respectively communicating with load (or input) and unload (or output) locks 16, 18, each of which has an outer port, respectively indicated at 20 and 22, that communicates with ambient atmosphere. An electric arc plasma gun supporting chamber 24 is fixed to and in communication with the processing chamber 10 and forms therewith a substantially T-shaped operating apparatus. An electric arc plasma spray gun 26 (see FIG. 6), such as, for example, the gun illustrated in U.S. Pat. No. 3,914,573, is mounted in the operating chamber leg 24 and arranged to direct a sprayed stream of powder bearing plasma to a part 28 positioned at an operating station within the spray chamber 10. Suitable access ports (not shown) on the side of chamber section 24 are provided for adjustment and minor modification of the gun within the chamber. A suitable support structure (not shown) carries the apparatus at a desired height.

A substantially continuous track 30 of generally C-shaped cross section extends through the chamber and its air locks from an entrance station 32 to an exit station 34. Each air lock can be individually and selectively sealed from the processing chamber and from ambient atmosphere by means of inner and outer valves 36, 38 for the input air lock and inner and outer valves 40, 42 for the output air lock. The valves include respective sliding valve gates 44, 46, 48, 50 that are driven vertically, upwardly and downwardly, by air motors 52, 54, 56, 58, respectively mounted upon upper ends of the several gate valves. Gate positions are signaled by sensors 53, 55, 57, and 59.

The otherwise continuous track 32 is provided with a plurality of valve gate gaps, there being one gap at each of the valve gates. The mutually facing ends of the track gap at each valve gate gap are positioned relatively close to, but spaced from, the respective gate (when the latter is closed), so that the gate can freely move between sealing and unsealing positions without interference or contact with the track.

Fixedly mounted to the track are a plurality of mutually spaced linear induction motor stators 60–72, inclusive. The induction motor stators are preferably spaced very close to one another, but, of course, are sufficiently spaced at the track gaps to permit motion of the valve gates through the gaps. A plurality of part carriers, such as those indicated at 76–81, inclusive, are mounted on the track for continuous sliding motion along the track from the entrance station 32, through the load lock 16, through the processing chamber 10, through the unload lock 18, and to the exit station 34.

As shown in FIG. 3, each carrier is formed of upper and lower plates 90, 92, separated by narrower interposed plate 94, to provide longitudinally extending and outwardly opening channels on each side of the carrier that slidably receive the inwardly projecting flanges 96, 98 on the lower side of the C-shaped track 30. Each carrier has an armature plate 100 fixed to the top of its upper plate 90 and positioned close to, but slightly spaced from, the undersurface of each of the linear motor stators. The stators thus form an armature path along the track for guiding and driving the several carriers. A plurality of carrier sensors, such as sensor 104 (shown in FIG. 3), are mounted to the track at selected points along the track to sense the arrival of a front portion of the carrier at the sensor location. At each of a number of selected locations along the track, there is provided a positive mechanical stop in the form of a bell crank 106 (FIGS. 3, 4) pivoted to the track on a fixed axis 108 and having a stop leg 110 that is normally positioned in the path of the carrier to ensure that the carrier stops at the chosen position. The bell crank stop 106 is pivoted to an out of the way position or disabled condition by means of a solenoid 112 having a drive rod 114 pivotally connected to a short leg 116 of the bell crank.

Figures 5, 8:
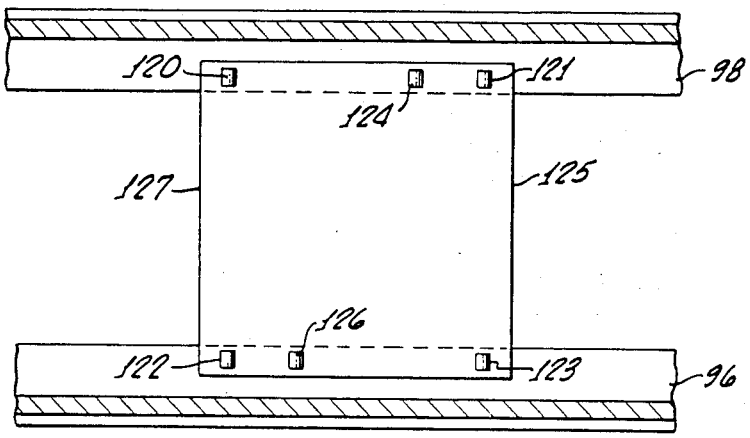
FIG. 5 illustrates the positioning of carrier wheels.
FIG. 8 is a chart schematically depicting various steps in a substantially continuous flow-through process.

Each carrier is provided with six rollers or wheels, three on each side, positioned as illustrated in FIG. 5. Wheels 120, 121, 122, and 123 are positioned at respective ones of the four corners of the carrier. On one side of the carrier, that of the wheels 120, 121, there is provided an intermediate wheel 124 that is spaced from wheel 121 at the front end 125 of the carrier by a distance that is slightly greater than the length of each track gap. Similarly, on the other side of the carrier, an intermediate wheel 126 is provided, spaced from roller 122 at the rear end 127 of the carrier by a distance slightly greater than the track gap. Intermediate roller 124 is spaced considerably further from roller 120 than it is from roller 121. Similarly, intermediate roller 126 is spaced further from roller 122 than it is from roller 123. This arrangement ensures that the carrier will never be supported by less than four of the rollers, even though a minimum number of rollers is employed and even through the track gaps must be crossed by the rollers.

First and second vacuum pumps 130, 132 are provided, as shown in FIG. 1. Vacuum pump 130 is connected to draw down pressure in both load and unload locks 16 and 18, and pump 132 is connected to draw down pressure in the processing chamber 10. Pump 132 will operate continuously to maintain the desired vacuum, which may be in the order of about one half psi (about 38,000 microns) for a typical low oxygen environment spraying operation. This vacuum pump removes the gases of the plasma spray and spray coating powder particles that do not adhere to the part. The air lock pump 130, on the other hand, is operated only intermittently to draw down pressure in the locks, as desired. When the outer valves of the air locks are closed and the inner valves opened (upon sensing of equal pressures in the air locks and processing chamber), a valve 134 interconnecting the two pumping systems is opened to allow both pumps to hold the vacuum in the locks and processing chamber, which are then interconnected.

Mounted within the processing chamber, one on each side of the track, and adjacent the load lock 16 are a pair of radiant heaters, of which that shown at 136 is illustrated in FIG. 2. The radiant heaters extend from the front of the processing chamber (adjacent the load lock) through first and second preheat stations for a length long enough to accommodate two carriers with the parts thereon. At a central position within the processing chamber is the spray station at which the carrier is stopped to enable the part to be sprayed. To allow the electric arc plasma gun to coat all sides of the part, each carrier includes a part holder 140 (FIG. 6) which carries a rotatably mounted driven gear 142 that is fixed to a part holding chuck 144. A drive shaft 146 extends through a top wall of the processing chamber from a motor 148 (FIG. 2) and is connected by means of a universal joint 150 and a driven shaft 152 to a drive gear 154 that is adapted to mesh with the driven gear 142. Shaft 152 carries a fixed collar 156 that is connected to an actuator piston 158 of a solenoid 160. Actuation and deactivation of solenoid 160 pivots the driven shaft 152 and drive gear 154 to and from a position in which drive gear 154 meshes with driven gear 142 on the carrier. Thus, the drive gear 154 can be retracted to allow a carrier to arrive at and depart from the spray station. For the spray operation, the drive gear is swung to an operative position in engagement with the carrier gear 142, after the carrier has been positioned at the spray station. Thus, upon actuation of motor 148, a part, such as a turbine blade 28, may be rotated to receive the plasma spray stream 164 projected from the electric arc plasma gun 26.

Gun 26 is mounted within the leg 24 of the T-shaped apparatus for three mutually orthogonal linear motions under control of screw drives 168, 170, and 172 driven by motors 174, 176, and 178, respectively. The gun is mounted to angularly sweep its projected plasma stream in a vertical plane in the orientation illustrated in FIG. 6. To this end, the gun is carried by a pair of meshing sector gears 180, 182. Gear 182 is rotated by an actuator rod 184 of an air cylinder 186. Air cylinder 186 is fixed to a second air cylinder 188, which is pivoted to gun mounting structure 190 by a pivotal connection between this structure and the actuator 192 of the second air cylinder 188.

It will be seen that individual parts may be continuously loaded into, processed within, and unloaded from the processing chamber, stopping only as necessary for the desired preheating and to accommodate the plasma spraying at the spray station. Accordingly, it will be understood that this flow-through processing comprises a continuous series of discrete steps. The term "continuous", as used herein to describe the process, does not necessarily imply that the parts are always moving, but that the parts move in a smooth sequence of discrete steps, one after the other. In this continuous type flow-through processing, as distinguished from a batch type processing, the parts are moved from one station to another one at a time. Similarly, the parts are loaded and unloaded one at a time.

The parts are moved through the processing system, including its input and output locks, in a continuous series of discrete steps. Each part stops within the load lock to enable a vacuum to be drawn in the lock. Then, after entry into the processing chamber, each part stops at each of the preheat stations while a preceding part is being sprayed. Each part remains for a period of time within the unload air lock while its valves are being closed and opened. As each part arrives substantially at its position within a given station, the carrier sensor 104 (or equivalent sensor at each stopping position) signals its arrival, and the appropriate stator or stators are de-energized. The carrier sensors provide position indication information to enable the stators to be de-energized in response to the appropriate sensor signals prior to the time that the carrier actually attains its desired station position. Thus, upon de-energization of the stators, the carriers decelerate until they meet the positive stop. There is a sensor for each air lock, one for each of the three chamber stations, and also one for each of the entrance and exit stations. The carriers are driven by energization of the appropriate stators which are connected to be individually energized and de-energized. When moving a carrier from one position to another, or, more specifically, from one stator to another, the two stators are energized at the same time, so that as soon as the armature of the carrier partially leaves a first stator, it is captured, at least in part, by the second (adjacent) stator, whereby the operation of the spaced stators inherently enables a part to be continuously driven across a gap in the track. Suitable electrical feed-through connections are provided into the processing chamber, and into the air locks for the electric lines that control the stators and solenoids, and for the sensor lines. Cooling of the chamber is provided by conventional cooling mechanisms (not shown).

Each carrier and its full length armature has a length substantially equal to the length of each stator, which may be in the order of eight to ten inches, for example. Thus, with stators spaced by distances of not more than about one and a half inches from one another, the carriers may be continuously driven, either by interaction of their armatures with a single stator or, when a carrier bridges two adjacent stators, by interaction of the carrier armature with the two stators that are bridged.

Operation of the described apparatus may be carried out in a sequence of totally individual and discrete steps, wherein each operation takes place only after an earlier step has been completed, or various steps may be combined to occur at the same time in order to decrease the cycle length.

For understanding an exemplary sequence, consider the apparatus loaded with carriers that bear turbine blades or the other parts, positioned at the spray and both preheat stations. Inner gates 44 and 48 are closed and sensors 53, 57 for these gates so indicate. Sensors at the preheat and spray stations indicate that the stations are occupied. Then outer gates 46 and 50 are opened. Presuming a carrier 81 with a completed product is in the unload lock, this shows on the sensor in this lock. The gates sensors 55, 59 indicate that the outer gates 46 and 50 are open, and the stop in the unload lock is released. Stators 70 and 71 are energized until carrier 81 moves under the sensor at the exit station 34. Stators 61 and 62 are energized until carrier 77 moves from the sensor at the entrance station to the sensor within the load lock. The carrier is stopped within the load lock by the mechanical stop. At this point the outer gates 46 and 50 are shut, and when conditions are equalized between the two locks and the processing chamber, as indicated by pressure sensors (not shown) in the locks and the chambers, the inner gates 44 and 48 are opened. Preheating and spraying are then accomplished.

When processing at the spray station has been completed, the mechanical stop at the spray station is released, and stators 66–70 are energized until carrier 80 is shifted out of the processing chamber and is detected by a sensor within the unload lock. Inner gate 48 of the unload lock is now shut. The stop at the second preheat station is released. Stators 65 and 66 are energized until the sensor spray station reports that transfer of a carrier from the preheat station to the spray station is complete. Then the stop at the first preheat station is released, and stators 63–65 are energized until a sensor at the second preheat station reports transfer completed. The release of each mechanical stop is momentary, and each returns to its blocking position as soon as the carrier that had been stopped has departed. The stop in the load lock is now released, stators 62 and 63 are energized until the sensor at the first preheat station reports transfer completed. Inner gate 44 is closed, and processing at the spray station will commence when the sensor at the spray station reports the carrier in position and the gate sensors report both inner gates are closed. Part bearing carriers are positioned at and removed from the entrance and exit stations whenever these stations are empty and occupied, respectively. The described cycle is then repeated.

Figure 7:
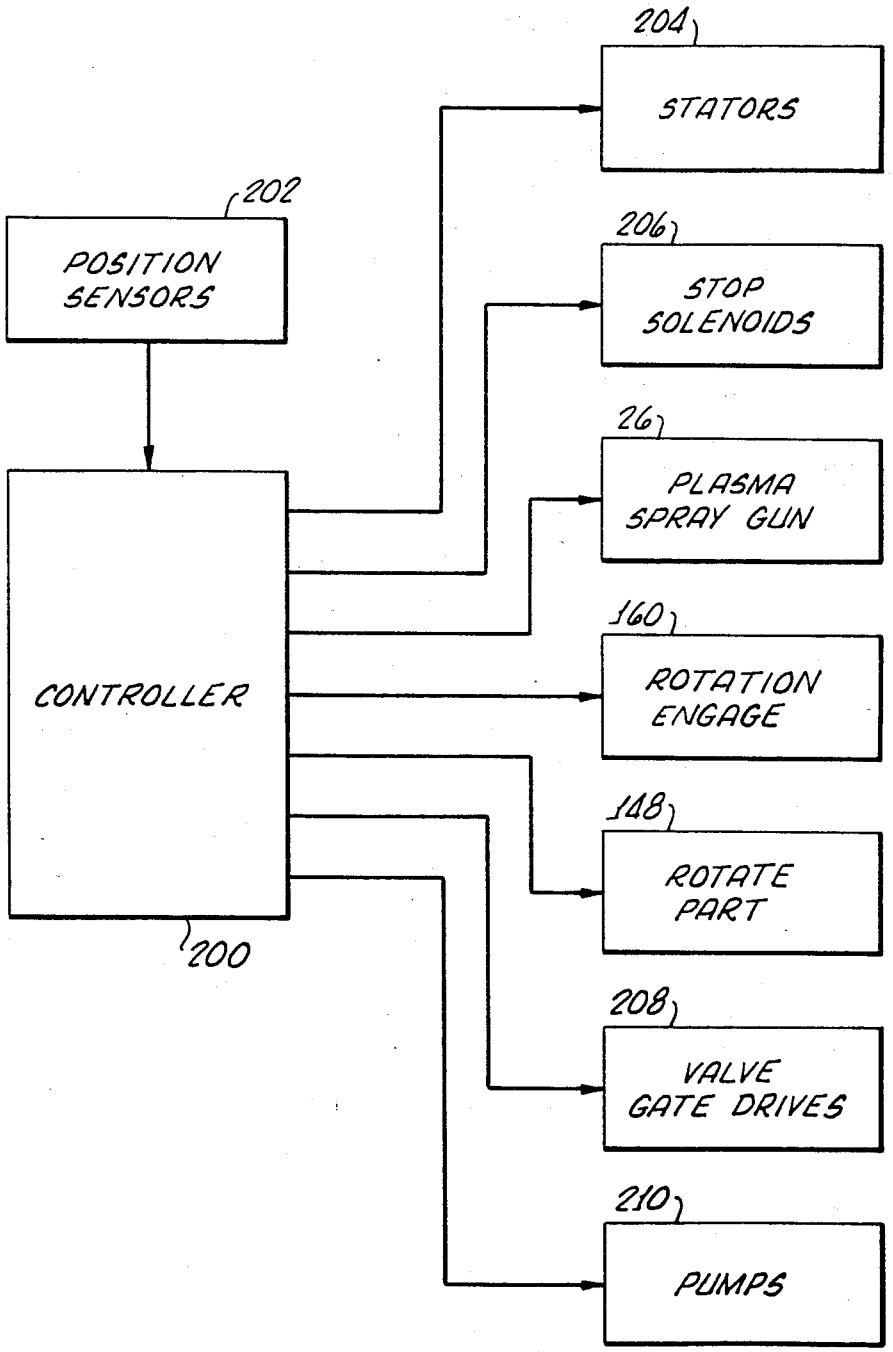
FIG. 7 illustrates the system control.

It will be readily appreciated that many different methods and control systems may be employed for sequencing of the various operating components. Operation of the several elements may be controlled manually, by a set of program cams, or by digital computer, all well known in the art. As indicated generally in FIG. 7, a control system, as presently preferred, embodies a programmed controller 200 that receives signals from position sensors (collectively indicated at 202) at each of the processing stations and other positions at which a part carrier is stopped. The controller sends signals to individual ones or groups of the stators (collectively indicated at 204), to the several mechanical stop solenoids 206, to the valve gate drives 208, and to pumps 210. Signals are also sent by the controller to the rotation drive gear solenoid 160 to effect engagement or disengagement of the gears, and to the rotation motor 148 to effect rotation of the part at the spray station. Signals for spraying are sent from the programmed controller to the plasma spray gun 26 to operate the gun for spraying when a part has been positioned at the spray station, as indicated by appropriate sensor signals.

As mentioned above, certain of the above described steps may take place simultaneously in order to decrease the cycle time, if deemed necessary or advisable, providing, however, that the parts must remain at the preheat stations and at the spray station for periods sufficient to perform the desired operations at these stations.

FIG. 8 illustrates a continuous series of steps in an alternative processing sequence and the several conditions of the various parts in each of the steps. In this figure, the vertical side of the chart represents the flow-through path and the several stations of the chamber in a sequence descending along the page. Thus, the first line indicates the entrance station 32, and the successively lower lines indicate condition of the outer load valve (as shown by C for closed or O for open), the load lock, condition of the inner load valve, preheat station 1, preheat station 2, the spray station, condition of the inner unload valve, the unload lock, the condition of the outer unload valve, and the exit station. Horizontally across the top of FIG. 8 are illustrated successive steps in the operation, numbered 1 through 7. Parts being processed through the chamber are denoted as $P_1$, $P_2$, $P_3$, etc., to indicate parts that are successively processed in the continuous series of steps of a process. It will be understood that FIG. 8 is merely exemplary of one alternative sequence of steps that may be carried out with the described apparatus.

Assuming that the system has been running prior to step 1 of FIG. 8, inner and outer load lock valves 44 and 46 are closed, inner unload valve 48 is closed, and outer unload valve 50 is closed. A first part $P_1$ is at the spray station, a second part $P_2$ is at the second preheat station, and a third part $P_3$ is at the first preheat station within the processing chamber. A fourth part $P_4$ is within the load lock, which is evacuated, and a fifth part $P_5$ is at the entrance station waiting to be loaded into the load lock. In the condition of step 1, several actiions may occur. Part $P_1$ at the spray station is sprayed, parts $P_2$ and $P_3$ at the preheat stations are heated by the radiant heater 136. The pressure in the locks is decreased. When sensors in the locks and in the main chamber indicate equality of pressure within the locks and the processing chamber, step 2 can occur. The inner load and unload valves 44 and 48 are opened, and each part is shifted to the next station by energization of the appropriate motor stators, to be positioned against the mechanical stop at the next station. Part $P_1$, which has just been sprayed, is shifted into the unload lock. Parts $P_2$ and $P_3$ are each moved to the succeeding stations, which are the spray station, and the second preheat station part $P_4$ is moved from the load lock to the first preheat station. The mechanical stops are disabled prior to enabling the stators for this shifting operation.

In step 3 both inner load gates are closed, spraying of part $P_2$ at the spray station is commenced, and preheating of parts $P_3$ and $P_4$ is also carried out. Outer load valve 46 is opened to allow shifting of the next part $P_5$ into the load lock. Outer unload valve 50 is opened to allow shifting of the sprayed part $P_1$ from the unload lock to the exit station 34. In step 4 the outer valves 46 and 50 are closed, and both locks are depressurized. Thereafter, upon equalization of the pressure in the locks and the processing chamber, the inner valves are opened, and each of the parts within the load lock and the processing chamber are shifted, so that part $P_2$ is now in the unload lock, part $P_3$ is at the spray station, and parts $P_4$ and $P_5$ are at the preheat stations. In step 5 the inner load valves are closed, part $P_3$ at the spray station is sprayed, the outer valves are opened, part $P_6$ is loaded into the load lock, and the sprayed part $P_2$ is removed from the unload lock. In steps 6 and 7 the prior operations described in steps 4 and 5 are repeated, and so on, in a continuous step-by-step processing.

With the described arrangement, moving only one part at a time, as in the sequence first described above, one part may be completed every 30 to 40 seconds. Spraying of one part can be accomplished in about seven seconds. With a similar dwell time at each of the two preheat stations, each part is within the processing chamber for less than forty seconds (considering the time required for starting, stopping, part transfer, and lock depressurization). Thus, the system can produce more than ninety parts per hour, as compared to the approximately ten parts per hour for prior batch processes commonly employed for spray coating.

Using pumps that each have a capacity of 150 cubic feet per minute, and with the volume of each of the locks being approximately seven cubic feet, each lock can readily be depressurized within a few seconds. There is no need to depressurize the large volume of the processing chamber, nor of the gun chamber, both of which remain continuously at the desired low pressure during all operations. Thus, both time and energy are conserved. Loading and unloading into the air locks may be accomplished while parts are being processed in the main chamber. Importantly, each part is directly removed from the chamber immediately after it has been sprayed. No completed part remains in the chamber for processing of other parts. This alleviates the significant problem of avoiding heat buildup within the chamber due to heat stored in the sprayed part, its support, and carrier.

Sealing of the chambers is greatly improved. The arrangement requires only one moving feed-through shaft, namely, the feed-through of shaft 146 for rotating the part being sprayed. All other feed-throughs are fixed electrical feed-throughs, which are readily available commercial items and subject to relatively little sealing problems. No mechanical actuating devices moves into and out of the several chambers and through the sealing valves. The arrangement allows a substantially continuous, but gapped, track to provide a continuous drive and continuous support for each carrier, and, yet, because of the gaps in the track, an efficient, reliably sealed sliding valve gate is employed.

The described system of one part per carrier is presently preferred for plasma spray coating of turbine blades. Nevertheless, it is contemplated that more than one part may be secured to each carrier, to be individually rotated on the carrier, and to move two at a time through the several processing and handling positions.

The described apparatus and method may be employed in the controlled environment spraying of many types of materials. It has been particularly designed for electric arc plasma spraying in low oxygen environments for use with materials such as various alloys of nickel, cobalt, chromium, aluminum, titanium, tantalum, and ytrrium. It is also useful for spraying of materials that may yield toxic gases in the spraying process. Vapors of copper, lead, bismuth, and cadmium, for example, are toxic and must be confined; thus, safe, rapid, and efficient spraying of such materials can be readily achieved with the described method and apparatus.

The foregoing detailed description is to be clearly understood as given by way of illustration and example only, the spirit and scope of this invention being limited solely by the appended claims.

What is claimed is:

1. A vacuum chamber plasma spraying system for continuous plasma spray coating of parts, said system comprising a vacuum chamber for receiving parts to be sprayed, means for decreasing pressure in said chamber, a plasma spray gun mounted in the chamber, input and output air locks, means for decreasing pressure in said air locks, entrance and exit ports connecting the chamber in sealed relation to respective air locks, entrance and exit closure members slidably mounted to alternatively open or close said ports, a track extending from said input air lock through the chamber and into said output air lock, said track having gaps at said ports for receiving said closure members, a plurality of carriers movably supported on the track, and a plurality of linear induction motors having mutually spaced stators mounted to and along the track, said gaps being positioned at spaces between said stators, whereby said closure members may also be received in the spaces between the stators, said motors including a plurality of armatures respectively fixed to individual carriers, whereby said carriers may be driven along the track and through said ports when said closure members are open.

2. The vacuum chamber plasma spraying system of claim 1 wherein said chamber is substantially T-shaped, having a spray gun section and a target section, said target section extending across one end of said spray gun section and communicating therewith, said track extending through said target section, said target section having a spray station adjacent said one end of said spray gun section, said spray gun being mounted in said spray gun section for plasma spray coating a part mounted on a carrier at said spray station.

3. The system of claim 2 including driven means movably mounted on at least some of said carriers for moving a part mounted on the carrier relative to the carrier, drive means mounted in said chamber adjacent said spray gun, means for selectively engaging said drive means and said driven means, and means for actuating said drive means whereby a part may be moved relative to the carrier and relative to said spray gun when said drive means are actuated.

4. The system of claim 3 wherein said plasma spray gun is movably mounted in said chamber to spray a pattern across a part on the carrier as the part is moved relative to the carrier and relative to the spray gun.

5. The system of claim 1 including a preheat station and a spray station in said chamber adjacent said track, sensor means at each said station for detecting presence of a carrier at the station, mechanical stop means at each said station for stopping a carrier at the station, and means for selectively disabling the stop means to permit a carrier to pass from the respective stations.

6. A flow-through plasma spraying system comprising a vacuum chamber having input and output air locks, track means in the chamber extending through the input air lock and through the output air lock, a plurality of object carriers movably supported on the track means, linear induction motor means for driving the carriers along the track means, said motor means comprising a plurality of mutually spaced stators mounted to said track means in said air locks and in said chamber, entrance and exit ports interconnecting said chamber with said air locks, entrance and exit inner valve gates slidably mounted to said locks for movement between open and closed positions, said track means having first and second gaps at said ports for receiving said gates in closed position, said gaps being positioned at spaces between adjacent ones of some of said stators whereby said gates may be received in said spaces, said motor means including a plurality of armatures each fixed to a respective one of said carriers, each said carrier having a support shoe movably supported by the track means and of a length sufficient to bridge each said gap.

7. The flow-through system of claim 6 wherein said chamber includes a preheat station followed by a spray station, and including means for stopping each carrier at each said station, whereby the part on each carrier is sequentially carried to and stopped at each said station, and each part is subjected to preheating prior to being sprayed at said spray station, and whereby the part on each carrier may be removed directly from the chamber after spraying.

8. The flow-through system of claim 6 wherein said air locks each includes an outer port and an outer valve gate mounted to the lock for selectively opening and closing the lock to ambient atmosphere, said input air lock having a length slightly greater than one of said stators, said one stator having opposite ends thereof positioned adjacent the inner and outer valve gates of said input air lock.

9. The flow-through system of claim 6 wherein said chamber includes a preheat station and a plasma spray station, mechanical stop means mounted in said chamber at each of said stations for engaging respective carriers at said stations, means for energizing selective ones of said stators to selectively drive said carriers to said stations, and means for disabling the mechanical stop means to permit motion of the carriers along the track.

10. The flow-through system of claim 6 wherein said track means comprises first and second elongated track members at opposite sides of said track means, each said support shoe having first and second sides corresponding to said first and second track members respectively, each said support shoe side having support rollers mounted on the shoe at forward and rear ends thereof, a first intermediate support roller on said first support shoe side spaced from the support roller at the forward end of said first side by a distance less than the length of said gaps, and a second intermediate support roller on said second support shoe side spaced from the roller at the rear end of said second support shoe side by a distance less than the length of said gaps.

11. A plasma spraying system comprising a target chamber including input and output bulkheads respectively formed with entrance and exit ports, an electric arc plasma spray gun in said chamber for spraying an object within the chamber, means for evacuating the chamber, inner entrance and exit valve gates slidably mounted in respective ones of said bulkheads for motion between a first position in which said ports are open and a second position in which said ports are closed, an input air lock connected to said input bulkhead in communication with said entrance port, an outout air lock connected to said output bulkhead in communication with said exit port, a track extending from said input air lock through said target chamber and into said output air lock, said track having entrance and exit gaps at said bulkheads for receiving said entrance and exit valve gates in said second position thereof, a plurality of linear motor stators fixedly mounted with respect to, and mutually spaced along, said track, the stators of a first pair of said stators being positioned adjacent to and on either side of said entrance valve gate, and the stators of a second pair of stators being positioned adjacent to and on either side of said exit valve gate, a plurality of carriers, each said carrier having a support shoe fixed thereto and shiftably engaged with said track, each said support shoe having a length greater than the length of said track gaps, whereby each said support shoe can bridge said gaps and support said carrier during motion through said ports, a plurality of armatures each mounted on a respective one of said carriers and positioned to move with said carriers along said track with the armatures in close proximity to said linear motor stators, each said armature having a length sufficient to bridge the space between adjacent stators, means for selectively energizing individual ones of said stators to drive said armatures and carriers along said track, and means for controlling the pressure within said air locks between ambient pressure and a pressure equal to the pressure within said target chamber.

12. The system of claim 11 wherein said chamber includes a preheating station adjacent said inner entrance valve gate for preheating a part that has entered said chamber, said chamber also including a spraying station at which a part on one of said carriers may be sprayed by said electric arc plasma spray gun, stop means on said track at said input air lock, at said preheating station and at said spraying station for stopping a carrier, and means for disabling said stop means to permit the carrier to move along the track past the stop means.

13. The system of claim 12 including sensor means in said input air lock, at said preheating station and at said spraying station for generating position signals indicative of the presence of a carrier at the respective stations, and means responsive to said position signals for controlling energization of said stators.

14. The system of claim 12 wherein said spraying station includes a rotation shaft journaled in said chamber, a rotation gear fixed to said shaft, and wherein said carrier includes a rotatably mounted carrier gear for rotating a part mounted on the carrier, including means for selectively shifting said rotation gear into and out of engagement with a carrier gear on a carrier positioned at said spraying station, and means for rotating said shaft.

15. The system of claim 11 wherein said track includes a loading section adjacent to but outside of said input air lock and an unloading section adjacent to but outside of said output air lock, said track having loading and unloading gaps at said air locks adjacent said loading and unloading sections, said linear motor stators including a loading stator fixedly mounted to said loading track section and an unloading stator fixedly mounted to said unloading track section, whereby a carrier may be mounted upon said loading track section for entrance into said input air lock, and whereby a carrier may be unloaded from said unloading track section after it leaves said output air lock.

16. The system of claim 11 wherein at least some of said carriers include a carrier plate having first and second sides, a front and a back, said carrier plate having first, second, third, and fourth corner rollers at respective ones of the four corners thereof, said carrier plate having a fifth roller on one of said sides adjacent the front of said carrier and spaced from a corner roller on said one side by a distance not greater than the space between adjacent stators, said carrier plate having a sixth roller on the other side of said carrier plate adjacent the back of said carrier plate and spaced from the corner roller at the back of the carrier plate by a distance not greater than the spacing between adjacent stators.

17. The method of plasma coating a part in a flow-through series of process steps comprising providing a controlled environment chamber with input and output air locks, plasma spray coating a part at a spraying station within said chamber, unloading a part from said output air lock while a part is at said spraying station, loading a part into said input air lock while a part is at said spraying station, providing said controlled environment to said air locks, shifting a part from said input air lock to said chamber and shifting a part from said chamber to said output air lock, sealing said chamber from said air locks, repeating said steps of loading and unloading said air locks, shifting parts to and from said chamber, providing the controlled environment to said air locks, and spraying a part in said chamber, said method further including preheating a part at a preheating station in said chamber while a part is being sprayed at said spraying station, shifting a part from said preheating station to said spraying station, shifting a part from said load lock into said chamber, said step of shifting a part from said load lock into said chamber including shifting a part to said preheat station, said air locks being provided with ports for selectively sealing the locks from the chamber and from ambient atmosphere, said shifting comprising mounting a track to extend through said air locks and through said chamber with gaps in the track at said ports, positioning linear motor stators along said track at opposite sides of the gaps, connecting motor armatures to said parts, selectively energizing individual ones of said stators, and sliding sealing gates into said track gaps to seal said chamber.

18. The method of plasma spray coating a plurality of parts in a series of discrete flow-through process steps comprising the steps of (a) providing a controlled environment chamber having input and output air locks, and having preheat and spray stations within the chamber, (b) positioning parts respectively at said preheat station and at said spray station, (c) preheating a part at said preheat station and plasma spraying a part at said spray station, (d) shifting a sprayed part from said spray station to said output lock, (e) loading a part into said input lock and unloading a part from said output lock, (f) providing both said locks with a controlled environment, (g) shifting a part from said spray station to said output air lock, from said preheat station to said spray station, and from said input air lock to said preheat station, (h) sealing said chamber from said air locks, (i) repeating steps (c) through (h) to continue to load, preheat, spray, and unload parts, (j) providing valve gates for sealing and unsealing said air locks, (k) providing a track extending through said chamber and through said air locks and having gaps at said valve gates, (l) moving said valve gates into and out of said gaps to unseal and seal said air locks, said steps of loading and shifting parts comprising (m) mounting linear motor stators on said track at both sides of said gaps, (n) loading parts on carriers having motors armatures, and (o) driving the carriers along the track and across the gaps by energizing the stators.

* * * * *